US007780415B2

(12) United States Patent
Liang

(10) Patent No.: US 7,780,415 B2
(45) Date of Patent: Aug. 24, 2010

(54) TURBINE BLADE HAVING A CONVERGENT CAVITY COOLING SYSTEM FOR A TRAILING EDGE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 418 days.

(21) Appl. No.: 11/707,226

(22) Filed: Feb. 15, 2007

(65) Prior Publication Data

US 2008/0273987 A1 Nov. 6, 2008

(51) Int. Cl.
*F01D 5/18* (2006.01)

(52) U.S. Cl. ..... 416/97 R; 415/115

(58) Field of Classification Search ..... 416/97 R, 416/96 R, 96 A; 415/115
See application file for complete search history.

(56) References Cited

U.S. PATENT DOCUMENTS

| | | | | |
|---|---|---|---|---|
| 4,767,268 | A * | 8/1988 | Auxier et al. | 416/97 R |
| 5,356,265 | A | 10/1994 | Kercher | |
| 5,403,159 | A * | 4/1995 | Green et al. | 416/97 R |
| 5,702,232 | A | 12/1997 | Moore | |
| 5,720,431 | A | 2/1998 | Sellers et al. | |
| 5,931,638 | A | 8/1999 | Krause et al. | |
| 6,551,062 | B2 * | 4/2003 | Leeke et al. | 416/97 R |
| 6,607,356 | B2 | 8/2003 | Manning et al. | |
| 6,902,372 | B2 | 6/2005 | Liang | |
| 6,932,573 | B2 | 8/2005 | Liang | |
| 6,981,846 | B2 | 1/2006 | Liang | |
| 7,413,407 | B2 * | 8/2008 | Liang | 416/97 R |
| 7,416,390 | B2 * | 8/2008 | Liang | 416/97 R |
| 2006/0056967 | A1 | 3/2006 | Liang | |
| 2006/0222494 | A1 | 10/2006 | Liang | |

FOREIGN PATENT DOCUMENTS

| | | | |
|---|---|---|---|
| EP | 1467065 | A2 | 4/2004 |
| EP | 1584790 | A2 | 10/2005 |

* cited by examiner

*Primary Examiner*—Igor Kershteyn

(57) ABSTRACT

A turbine blade including an airfoil defining an airfoil cavity forming a cooling system in the blade. First, second and third ribs are positioned in the airfoil cavity to form first, second and third generally elongated cooling cavities along at least a portion of the span-wise direction of the airfoil in an area adjacent the trailing edge of the airfoil. Each of the ribs includes a plurality of orifices for conveying a cooling fluid into each of the cavities. Each of the cavities includes a pair of converging walls, angling inwardly relative to an outer surface of the airfoil, to increase the impingement of cooling fluid from the orifices onto the cavity walls, and increase the cooling effectiveness within the trailing edge of the airfoil.

20 Claims, 3 Drawing Sheets

FIG. 2
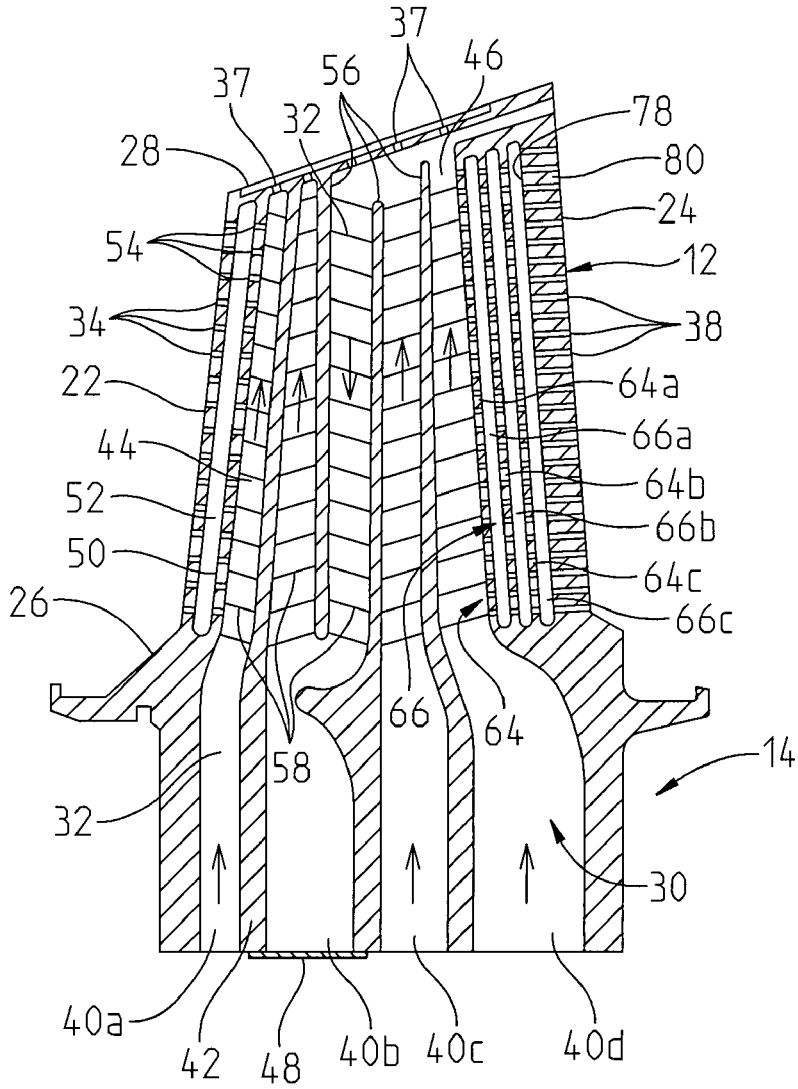
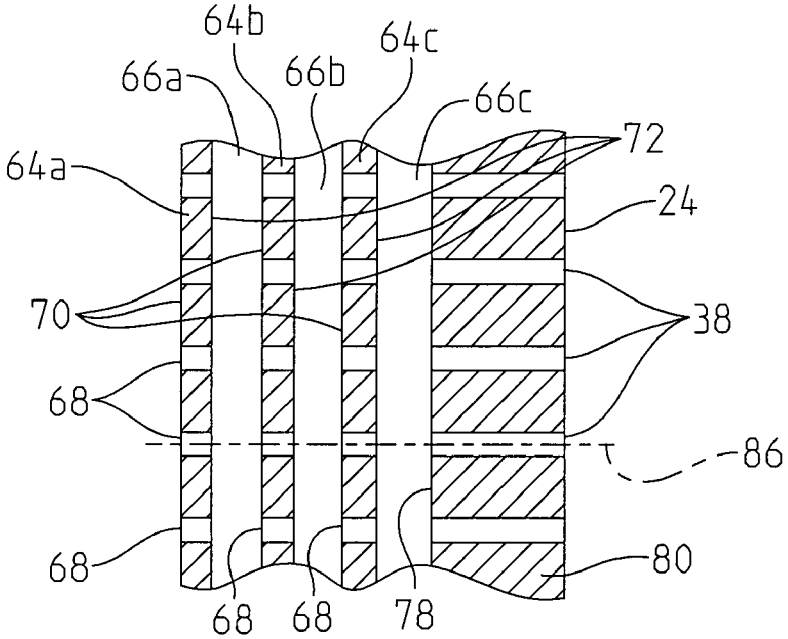
FIG. 3

TURBINE BLADE HAVING A CONVERGENT CAVITY COOLING SYSTEM FOR A TRAILING EDGE

FIELD OF THE INVENTION

This invention is directed generally to turbine blades and, more particularly, to a turbine blade having cooling cavities for conducting a cooling fluid to cool a trailing edge of the blade.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil is ordinarily composed of a tip, leading edge and a trailing edge. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results in high stresses being generated in numerous areas of a turbine blade. One particular area of high stress is found in the blade's trailing edge, which is a portion of the blade forming a relatively thin edge that is generally orthogonal to the flow of gases past the blade and is on the downstream side of the blade. Because the trailing edge is relatively thin and an area prone to development of high stresses during operation, the trailing edge is highly susceptible to formation of cracks. These cracks may propagate and cause failure of the blade, which may, in some situations, cause catastrophic damage to a turbine engine.

A conventional cooling system in a turbine blade assembly may discharge a substantial portion of the cooling air through a trailing edge of the blade. Typically, the cooling system contains an intricate maze of cooling flow paths in the trailing edge. There exist numerous configurations of the cooling flow paths that attempt to maximize the convection occurring in a trailing edge of a blade. While many of these conventional systems have operated successfully, a need still exists to provide increased cooling capability in the trailing edge portions of turbine blades.

SUMMARY OF THE INVENTION

In accordance with one aspect of the invention, a turbine blade is provided comprising an airfoil including an airfoil outer wall extending in a span-wise direction radially outwardly from a blade root. A blade tip surface is located at an end of the airfoil distal from the root, and the airfoil outer wall includes pressure and suction side surfaces joined together at chordally spaced apart leading and trailing edges of the airfoil. The airfoil defines an airfoil cavity forming a cooling system in the blade. At least a first rib is positioned in the airfoil cavity to form at least a first generally elongated cooling cavity along at least a portion of the span-wise direction in an area adjacent the trailing edge of the airfoil, the first rib including an upstream side and a downstream side. The first cooling cavity comprises a cavity pressure sidewall and a cavity suction sidewall extending from the downstream side of the first rib. The first rib includes at least one orifice extending through the first rib from the upstream side to the downstream side, and the cavity pressure and suction sidewalls define convergent cavity sidewalls relative to the pressure and suction side surfaces of the outer wall.

In accordance with another aspect of the invention, a turbine blade is provided comprising an airfoil including an airfoil outer wall extending in a span-wise direction radially outwardly from a blade root. A blade tip surface is located at an end of the airfoil distal from the root, and the airfoil outer wall includes pressure and suction side surfaces joined together at chordally spaced apart leading and trailing edges of the airfoil. The airfoil defines an airfoil cavity forming a cooling system in the blade. A first rib is positioned in the airfoil cavity to form a first generally elongated cooling cavity along at least a portion of the span-wise direction in an area adjacent the trailing edge of the airfoil, the first rib including an upstream side and a downstream side. The first cooling cavity comprises a cavity pressure sidewall and a cavity suction sidewall extending from the downstream side of the first rib, the first rib including a plurality of orifices extending through the first rib from the upstream side to the downstream side thereof. A second rib is positioned in the airfoil cavity to form a second generally elongated cooling cavity adjacent to the first cooling cavity, the second rib including an upstream side and a downstream side. The second cooling cavity comprises a cavity pressure sidewall and a cavity suction sidewall extending from the downstream side of the second rib, the second rib including a plurality of orifices extending through the second rib from the upstream side to the downstream side thereof. The cavity pressure and suction sidewalls in each of the first and second cooling cavities define convergent cavity sidewalls relative to the pressure and suction side surfaces of the outer wall.

In accordance with a further aspect of the invention, a turbine blade is provided comprising an airfoil including an airfoil outer wall extending in a span-wise direction radially outwardly from a blade root. A blade tip surface is located at an end of the airfoil distal from the root, and the airfoil outer wall includes pressure and suction side surfaces joined together at chordally spaced apart leading and trailing edges of the airfoil. The airfoil defining an airfoil cavity forming a cooling system in the blade. A first rib positioned in the airfoil cavity to form a first generally elongated cooling cavity along at least a portion of the span-wise direction in an area adjacent the trailing edge of the airfoil, the first rib including an upstream side and a downstream side. The first cooling cavity comprising a cavity pressure sidewall and a cavity suction sidewall extending from the downstream side of the first rib, the first rib including a plurality of orifices extending through the first rib from the upstream side to the downstream side thereof. A second rib positioned in the airfoil cavity to form a second generally elongated cooling cavity adjacent to the first cooling cavity, the second rib including an upstream side and a downstream side. The second cooling cavity comprising a cavity pressure sidewall and a cavity suction sidewall extending from the downstream side of the second rib, the second rib including a plurality of orifices extending through the second rib from the upstream side to the downstream side thereof. A third rib positioned in the airfoil cavity to form a third generally elongated cooling cavity adjacent to the second cooling cavity, the third rib including an upstream side and a downstream side. The third cooling cavity comprising a cavity pressure sidewall and a cavity suction sidewall extending from the downstream side of the third rib, the third rib including a plurality of orifices extending through the third rib from the upstream side to the downstream side thereof. Each of the orifices in the third rib is substantially centered on a line extending along a centerline of a corresponding orifice in each of the first and second ribs.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 2 is a cross-sectional view of the turbine blade shown in FIG. 1 taken along line 2-2;

FIG. 3 is an enlarged detail view of the trailing edge of the turbine blade shown in FIG. 2;

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
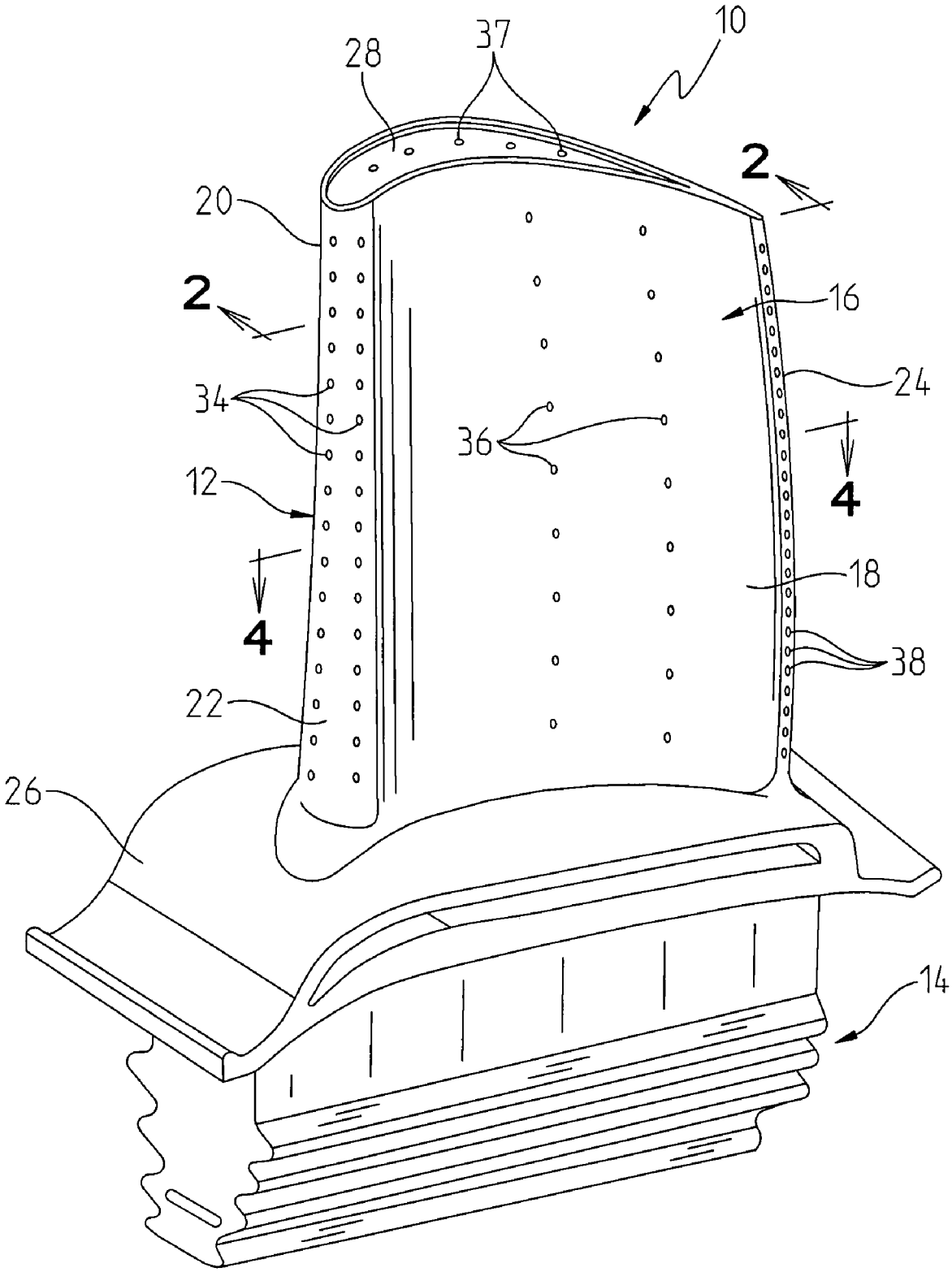
FIG. 1 is a perspective view of a turbine blade incorporating the present invention.

Referring to FIG. 1, an exemplary turbine blade 10 for a gas turbine engine is illustrated. The blade 10 includes an airfoil 12 and a root 14 which is used to conventionally secure the blade 10 to a rotor disk of the engine for supporting the blade 10 in the working medium flow path of the turbine where working medium gases exert motive forces on the surfaces thereof. The airfoil 12 has an outer wall 16 comprising a generally concave pressure sidewall 18 and a generally convex suction sidewall 20. The pressure and suction sidewalls 18, 20 are joined together along an upstream leading edge 22 and a downstream trailing edge 24. The leading and trailing edges 22, 24 are spaced axially or chordally from each other. The airfoil 12 extends radially along a longitudinal or radial direction of the blade 10, defined by a span of the airfoil 12, from a radially inner airfoil platform 26 to a radially outer blade tip surface 28.

Figure 4:
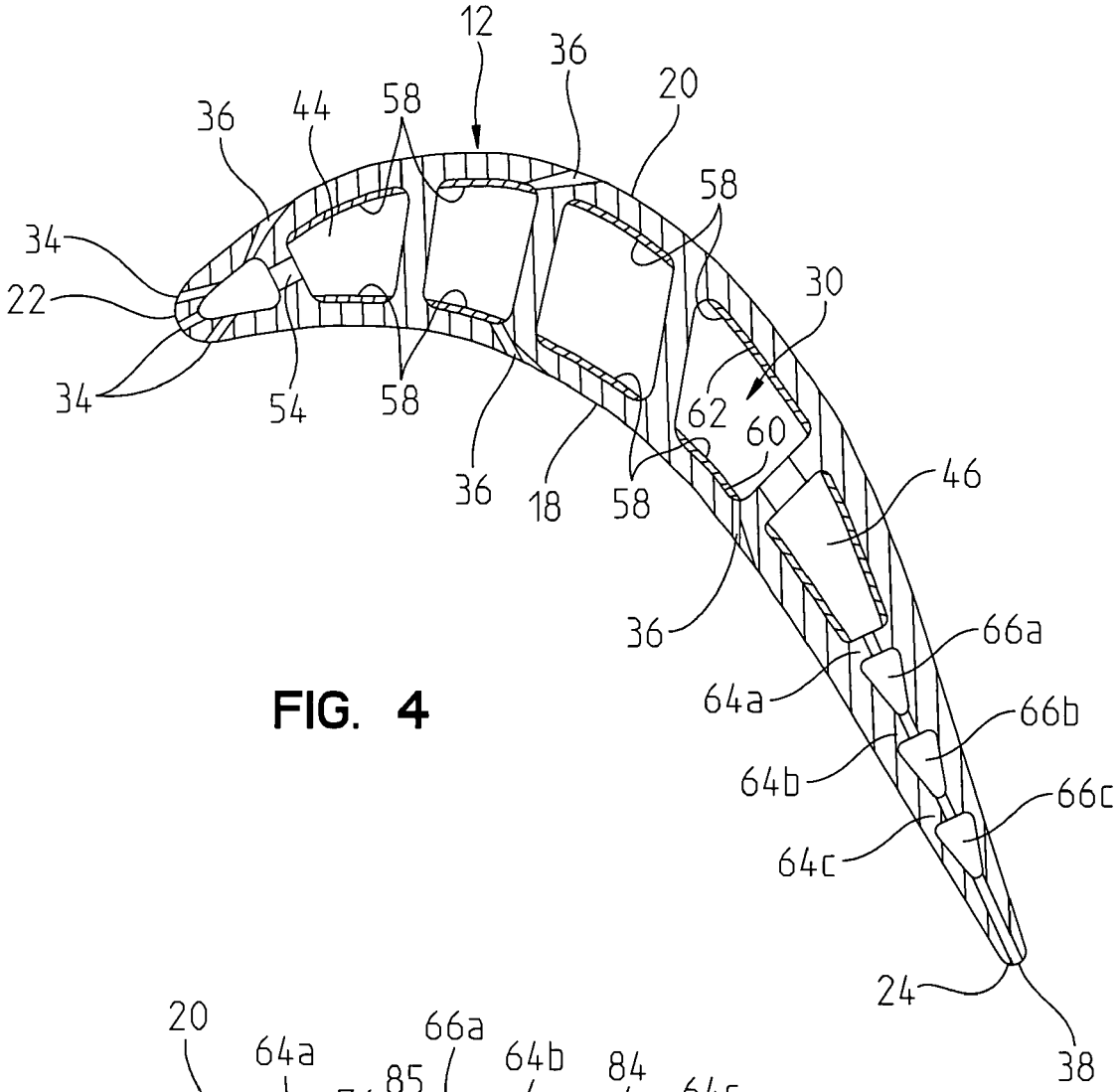
FIG. 4 is cross-sectional view of the turbine blade shown in FIG. 1 taken along line 4-4.

Referring to FIGS. 2 and 4, the airfoil 12 defines one or more cavities 30 positioned between the pressure sidewall 18 and the suction sidewall 20. The cavity 30 may include one or more cooling paths 32 (FIG. 2) for directing a cooling fluid, such as cooling air, through the airfoil 12 and out various orifices or openings in the outer wall 16 of the airfoil 12. For example, leading edge orifices or openings 34 may be provided in the leading edge 22 of the airfoil 12, and additional surface film cooling orifices or openings 36 may be provided in the pressure and suction sidewalls 18, 20. In addition, the tip surface 28 may also be provided with cooling openings 37, as required to reduce temperatures across the tip surface 28. Further, the trailing edge 24 is preferably also provided with trailing edge cooling orifices or openings 38 spaced along the trailing edge 24 in a span-wise direction, as will be described further below with regard to the cooling configuration for the trailing edge area of the airfoil 12.

The cavity 30 may be arranged in various configurations. For example, as illustrated in FIG. 2, cavity 30 may form cooling chambers that extend through the root 14 and airfoil 12. In particular, the cavity 30 may extend from a location adjacent the tip surface 28 to one or more cooling fluid inlet openings 40*a*, 40*b*, 40*c*, 40*d* at an end of the root 14. Alternatively, the cavity 30 may be formed only in portions of the airfoil 12. The openings 40*a*, 40*b*, 40*c*, 40*d* may be configured to receive the cooling fluid, such as air from the compressor. Cavity 30 may include a rib 42 dividing the cavity 30 into a first elongated cooling chamber 44 positioned proximate the leading edge 22, and a second elongated cooling chamber 46 positioned proximate the trailing edge 24. In addition, one or more plates 48 may be provided to control or direct flow of the cooling fluid through the cavity 30, such as by closing off one or more of the inlet openings 40*a*, 40*b*, 40*c*, 40*d*, and shown herein as closing off the inlet opening 40*b*.

The first elongated cooling chamber 44 may include any number of cooling paths. For example, and not by way of limitation, the first elongated cooling chamber 44 may include a divider 50 forming a leading edge cooling chamber 52 proximate to the leading edge 22. The divider 50 may include one or more orifices 54 and, by way of example, may include a plurality of orifices 54 that may or may not be equally spaced relative to each other along the divider 50. In addition, one or more of the leading edge orifices 34 extend from the leading edge cooling chamber 52 to the outer surface of the leading edge 22, and may be arranged in the leading edge 22 to form a shower head to expel cooling fluid from the first elongated cooling chamber 44.

The second elongated cooling chamber 46, which may also be referred to as a body cavity of the airfoil 12, may include any number of cooling paths. For example, and not by way of limitation, the second elongated cooling chamber 46 may include one or more dividers 56 forming a serpentine cooling path. The sidewalls of the cavity 30 may further be provided with trip strips 58 along the interior surfaces 60, 62 of the pressure and suction sidewalls 18, 20, respectively, to increase turbulence of the flow of cooling air along the interior surfaces 60, 62 (see also FIG. 4), and thereby improve heat transfer at the boundary layer between the cooling air flow and the interior surfaces 60, 62. The configurations described above for the first and second elongated cooling paths 44, 46 may be arranged as described above and shown in FIG. 2, or may have other configurations appropriate to dissipate heat from the airfoil 12 during use.

Referring to FIGS. 2 and 4, the cavity 30 may additionally include one or more impingement ribs 64 dividing cavity 30 and forming one or more elongated trailing edge cooling cavities 66 adjacent the second elongated cooling chamber 46. The one or more impingement ribs 64 and trailing edge cooling cavities 66 may extend along only a portion of the distance between the platform 26 and the tip surface 28 or, alternatively, may extend substantially the entire distance between the platform 26 and the tip surface 28. In a preferred non-limiting embodiment illustrated herein, the impingement ribs 64 comprise a first rib 64*a*, a second rib 64*b* and a third rib 64*c* forming a first cooling cavity 66*a*, a second cooling cavity 66*b* and a third cooling cavity 66*c*, respectively. It should be understood that the designations of "first", "second" and "third" are provided for convenience in describing the invention, and are not intended to be construed as limiting as to the particular location and/or number of impingement ribs 64 and cooling cavities 66.

Figure 5:
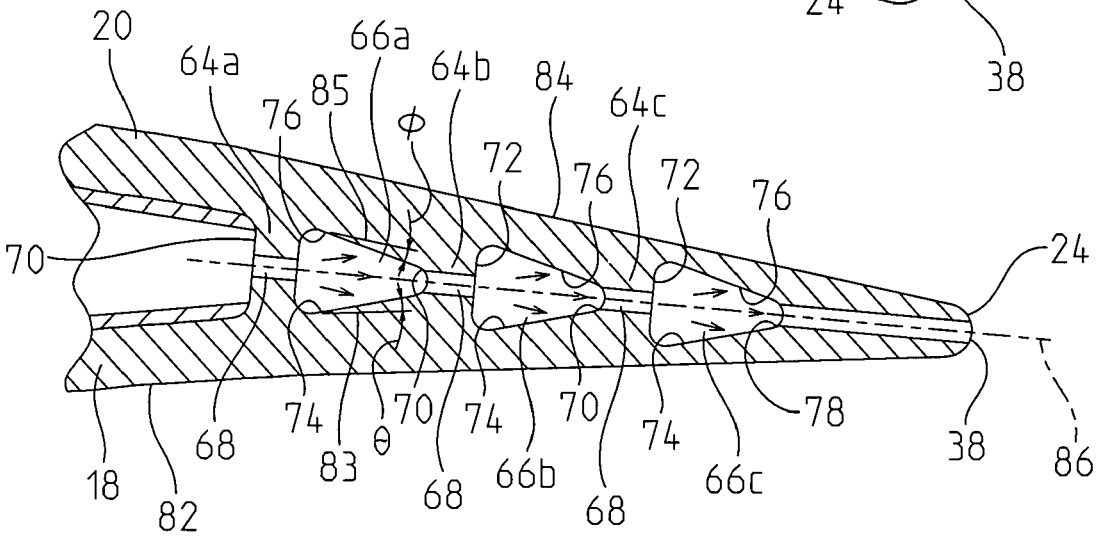
FIG. 5 is an enlarged detail view of the trailing edge of the turbine blade shown in FIG. 4.

Referring further to FIGS. 3 and 5, each of the ribs 64*a*, 64*b*, 64*c* includes one or more orifices 68 extending from an upstream side 70 to a downstream side 72 of each of the ribs 64*a*, 64*b*, 64*c*. The orifices 68 in each rib 64*a*, 64*b*, 64*c* are arranged in spaced relation to each other and may be located in uniform or equidistance spaced relation to each other. However, it should be understood that the present invention is not limited to any particular spacing between orifices 68, and that the spacing between the orifices 68 along any of the impingement ribs 64 may vary. Further, although the ribs 64 are illustrated as having orifices 68 along substantially the entire span-wise length thereof, the orifices 68 may located at only selected span-wise locations along the impingement ribs 64, as needed for the particular cooling requirements of the airfoil 12.

A pair of cooling cavity sidewalls comprising a cavity pressure sidewall 74 and a cavity suction sidewall 76 extends in a downstream direction from the downstream side 72 of the impingement ribs 64. The cavity pressure and suction sidewalls 74, 76 of the first and second cavities 66*a*, 66*b* terminate at the upstream sides 70 of the second and third ribs 64*b*, 64*c*, respectively, and the cavity pressure and suction sidewalls 74, 76 of the third cavity 66*c* terminate at an upstream side 78 of a trailing section 80 defining the trailing edge 24. The orifices 68 exit the impingement ribs 64 at the middle of the downstream sides 72, generally midway between the cavity pressure and suction sidewalls 74, 76.

As seen in FIGS. 4 and 5, the pairs of cavity pressure and suction sidewalls 74, 76 extend in the downstream direction in converging relation to each other, such that the cavities 66*a*, 66*b*, 66*c* each define a generally triangular or teardrop shape where the downstream side 72 of each rib 64*a*, 64*b*, 64*c* forms the base of the triangular shape. It may be seen with reference to the first cavity 64*a* in FIG. 5 that the cavity pressure sidewall 74 angles inwardly at an acute angle θ away from a line 83 parallel to an outer surface 82 of the pressure sidewall 18, and the cavity suction sidewall 76 angles inwardly at an acute angle ϕ away from a line 85 parallel to an outer surface 84 of the suction sidewall 20, such that the thickness of the side walls 18, 20 increases along the cavity 66*a* in the direction of cooling fluid flow. The angle θ may be equal to the angle ϕ, or the angles θ and ϕ may comprise different acute angles. The converging cavity sidewalls 74, 76 increase the impingement angle of the cooling air jet passing through the orifices 68 relative to the sidewalls 74, 76 to increase the cooling effect on the pressure and suction sidewalls 18, 20 in the area of the trailing edge 24. Each of the second and third cooling cavities 66*b*, 66*c* may be formed with angled sidewalls 74, 76, similar to the angled sidewalls 74, 76 described for the first cooling cavity 66*a*, angling inwardly from the respective pressure and suction sidewall surfaces 82, 84. The convergent angles θ and ϕ are preferably in the range of approximately 10 to 30 degrees.

Further, it may be noted that the outer surfaces 82, 84 of the pressure and suction sidewalls 18, 20 are preferably formed as substantially straight planar surfaces, extending the in the span-wise direction, in the area of the trailing edge 24. Specifically, the airfoil 12 may be formed with at least the trailing edge 24 formed as a substantially straight edge. For example, the airfoil 12 incorporating the cooling configuration of the present invention may be formed in accordance with the external airfoil profile disclosed in co-pending U.S. application Ser. No. 11/707,190, which application is incorporated herein by reference.

The orifices 68 and trailing edge openings 38 are preferably formed as drilled holes, in contrast to orifices or openings formed by typical casting processes. The drilled holes permit a smaller orifice 68 and opening 38 to be formed than may be provided by casting. For example, the diameter of the drilled orifices 68 and openings 38 is preferably in the range of 0.8 mm to 1.0 mm, whereas due to the fragile nature of the ceramic core required for the casting process, it is typically necessary to form cast holes with a diameter on the order of 1.5 mm to 2.0 mm to avoid breakage of the delicate ceramic core material during manufacture of the airfoil.

As illustrated in FIGS. 3 and 5, the orifices 68 in each of the successive ribs 64*a*, 64*b*, 64*c* and respective openings 38 are aligned or centered on a common centerline 86. Accordingly, each series of orifices 68 in the impingement ribs 64*a*, 64*b*, 64*c* and the associated trailing edge opening 38 aligned along a common centerline 86 may be formed by passage of a drill, during a drilling operation, into a specified location at the trailing edge 24 of the airfoil 12. The provision of drilled holes permits control of the flow rate through the trailing edge cavities 66 without the previous constraints associated casting geometry requirements, allowing the present configuration to achieve a lower cooling fluid flow rate as the cooling fluid travels toward the trailing edge openings 38, and permitting optimization of the cooling fluid flow rate by allowing variation of the drilled hole size. Further, the drilled holes increase the design flexibility in that the particular span-wise locations, as well as number, of the orifices 68 and openings 38 may be determined and/or changed to obtain a desired temperature profile for the airfoil 12.

During operation of the turbine, cooling fluid, such as cooling air, passes into the second elongated cooling chamber 46 through the cooling fluid inlet openings 40*c* and 40*d*, and passes through the orifices 68 in the first rib 64*a* and is expanded to impinge on the convergent walls 74, 76 in the first cooling chamber 66*a*. The cooling fluid is then contracted through the orifices 68 in the second rib 64*b* and is expanded to impinge on the convergent walls 74, 76 in the second cooling chamber 66*b*. The cooling fluid is then contracted through the orifices 68 in the third rib 64*c* and is expanded to impinge on the convergent walls 74, 76 in the third cooling chamber 66*c*. Finally, the cooling fluid is contracted through the trailing edge openings 38 and discharged from the airfoil 12 at the trailing edge 24.

From the above description, it may be seen that the multiple impingement cavity design provided at the trailing edge 24 increases the cooling effectiveness in the area of the trailing edge 24. Also, in contrast to known designs incorporating cavity sidewalls that are parallel to the sides of the airfoil, the present invention increases the convective heat transfer within the trailing edge cavities 66 by providing converging cavity sidewalls 74, 76 that are angled inwardly relative to the adjacent surfaces 82, 84 of the airfoil outer wall 16, such that the angle of impingement of air passing through each orifice 68 is increased. As a result of multiple impingements onto the successive convergent walls 74, 76 in the cavities 66, a higher rate of heat transfer is provided in the trailing edge area of the airfoil 12.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade, comprising:

an airfoil including an airfoil outer wall extending in a span-wise direction radially outwardly from a blade root;

a blade tip surface located at an end of said airfoil distal from said root, and said airfoil outer wall including pressure and suction side surfaces joined together at chordally spaced apart leading and trailing edges of said airfoil, said airfoil defining an airfoil cavity forming a cooling system in said blade;

at least a first rib positioned in said airfoil cavity to form at least a first generally elongated cooling cavity along at least a portion of said span-wise direction in an area adjacent said trailing edge of said airfoil, said first rib including an upstream side and a downstream side;

said first cooling cavity comprising a cavity pressure sidewall and a cavity suction sidewall extending from said downstream side of said first rib;

said first rib including at least one orifice extending through said first rib from said upstream side to said downstream side; and wherein said cavity pressure and suction sidewalls define convergent cavity sidewalls relative to said pressure and suction side surfaces of said outer wall.

2. The turbine blade of claim 1, wherein said cavity pressure sidewall angles away from said pressure side surface and said cavity suction sidewall angles away from said suction side surface.

3. The turbine blade of claim 1, wherein said cavity pressure and suction sidewalls angle inwardly from lines extending parallel to said pressure and suction side surfaces, respectively, at an angle within a range of approximately 10 to 30 degrees.

4. The turbine blade of claim 3, wherein said downstream side of said first rib extends between said cavity pressure and suction sidewalls, said at least one orifice is located substantially midway between said cavity pressure and suction sidewalls, and said first cooling cavity has a generally triangular shape with said downstream side of said first rib defining a base portion of said triangular shape.

5. The turbine blade of claim 1, further comprising a second rib defining a second cooling cavity adjacent said first cooling cavity, said second rib including at least one orifice substantially centered on a line extending along a centerline of said at least one orifice in said first rib.

6. The turbine blade of claim 5, further comprising a third rib defining a third cooling cavity adjacent said second cooling cavity, said third rib including at least one orifice substantially centered on said line extending along said centerline of said at least one orifice in said first rib.

7. The turbine blade of claim 6, wherein said orifices in said first, second and third ribs comprise drilled holes.

8. The turbine blade of claim 1, wherein said trailing edge comprises an outlet opening substantially centered on a line extending along a centerline of said at least one orifice in said first rib.

9. The turbine blade of claim 8, wherein said pressure and suction side surfaces each comprise planar surfaces extending along a chordal distance from said trailing edge to at least said first rib from said blade root to said blade tip surface.

10. A turbine blade, comprising:

an airfoil including an airfoil outer wall extending in a span-wise direction radially outwardly from a blade root;

a blade tip surface located at an end of said airfoil distal from said root, and said airfoil outer wall including pressure and suction side surfaces joined together at chordally spaced apart leading and trailing edges of said airfoil, said airfoil defining an airfoil cavity forming a cooling system in said blade;

a first rib positioned in said airfoil cavity to form a first generally elongated cooling cavity along at least a portion of said span-wise direction in an area adjacent said trailing edge of said airfoil, said first rib including an upstream side and a downstream side;

said first cooling cavity comprising a cavity pressure sidewall and a cavity suction sidewall extending from said downstream side of said first rib, said first rib including a plurality of orifices extending through said first rib from said upstream side to said downstream side thereof;

a second rib positioned in said airfoil cavity to form a second generally elongated cooling cavity adjacent to said first cooling cavity, said second rib including an upstream side and a downstream side;

said second cooling cavity comprising a cavity pressure sidewall and a cavity suction sidewall extending from said downstream side of said second rib, said second rib including a plurality of orifices extending through said second rib from said upstream side to said downstream side thereof; and wherein said cavity pressure and suction sidewalls in each of said first and second cooling cavities define convergent cavity sidewalls relative to said pressure and suction side surfaces of said outer wall.

11. The turbine blade of claim 10, wherein said cavity pressure sidewalls of said first and second cooling cavities angle away from said pressure side surface and said cavity suction sidewalls of said first and second cooling cavities angle away from said suction side surface.

12. The turbine blade of claim 10, including a third rib positioned in said airfoil cavity to form a third generally elongated cooling cavity adjacent to said second cooling cavity, said third rib including an upstream side and a downstream side, said third cooling cavity comprising a cavity pressure sidewall and a cavity suction sidewall extending in converging relationship relative to said pressure and suction side surfaces from said downstream side of said third rib, said third rib including a plurality of orifices extending through said third rib from said upstream side to said downstream side thereof.

13. The turbine blade of claim 12, wherein each of said orifices in said third rib is substantially centered on a line extending along a centerline of a corresponding orifice in each of said first and second ribs.

14. The turbine blade of claim 13, wherein said pressure and suction side surfaces each comprise planar surfaces extending along a chordal distance from said trailing edge to include at least said first, second and third ribs, and extending from said blade root to said blade tip surface.

15. The turbine blade of claim 14, wherein said orifices in said first, second and third ribs comprise drilled holes.

16. A turbine blade, comprising:

an airfoil including an airfoil outer wall extending in a span-wise direction radially outwardly from a blade root;

a blade tip surface located at an end of said airfoil distal from said root, and said airfoil outer wall including pressure and suction side surfaces joined together at chordally spaced apart leading and trailing edges of said airfoil, said airfoil defining an airfoil cavity forming a cooling system in said blade;

a first rib positioned in said airfoil cavity to form a first generally elongated cooling cavity along at least a portion of said span-wise direction in an area adjacent said trailing edge of said airfoil, said first rib including an upstream side and a downstream side;

said first cooling cavity comprising a cavity pressure sidewall and a cavity suction sidewall extending from said downstream side of said first rib, said first rib including a plurality of orifices extending through said first rib from said upstream side to said downstream side thereof;

a second rib positioned in said airfoil cavity to form a second generally elongated cooling cavity adjacent to said first cooling cavity, said second rib including an upstream side and a downstream side;

said second cooling cavity comprising a cavity pressure sidewall and a cavity suction sidewall extending from said downstream side of said second rib, said second rib including a plurality of orifices extending through said second rib from said upstream side to said downstream side thereof;

a third rib positioned in said airfoil cavity to form a third generally elongated cooling cavity adjacent to said second cooling cavity, said third rib including an upstream side and a downstream side;

said third cooling cavity comprising a cavity pressure sidewall and a cavity suction sidewall extending from said downstream side of said third rib, said third rib including a plurality of orifices extending through said third rib from said upstream side to said downstream side thereof; and wherein each of said orifices in said third rib is substantially centered on a line extending along a centerline of a corresponding orifice in each of said first and second ribs.

17. The turbine blade of claim 16, wherein said orifices in said first, second and third ribs comprise drilled holes.

18. The turbine blade of claim 16, wherein said pressure and suction side surfaces each comprise planar surfaces extending along a chordal distance from said trailing edge to include at least said first, second and third ribs, and extending from said blade root to said blade tip surface.

19. The turbine blade of claim 16, wherein said cavity pressure and suction sidewalls in each of said first, second and third cooling cavities define convergent cavity sidewalls relative to said pressure and suction side surfaces of said outer wall.

20. The turbine blade of claim 19, wherein the thickness of said airfoil outer wall, adjacent said pressure and suction side surfaces, increases proceeding in a chordal direction along each of said first, second and third cooling cavities, respectively.

* * * * *